US006460277B1

(12) United States Patent
Tower

(10) Patent No.: US 6,460,277 B1
(45) Date of Patent: Oct. 8, 2002

(54) PROMOTIONAL PRODUCTS

(76) Inventor: Robert Tower, 281 Lake Dr., Coconut Creek, FL (US) 33066

( * ) Notice: Subject to any disclaimer, the term of this patent is extended or adjusted under 35 U.S.C. 154(b) by 0 days.

(21) Appl. No.: 09/468,214

(22) Filed: Dec. 20, 1999

(51) Int. Cl.[7] ..... A44C 3/00
(52) U.S. Cl. ..... 40/1.5; 40/427; 40/493
(58) Field of Search ..... 40/1.5, 1.6, 427, 40/587, 497, 493; D20/21

(56) References Cited

U.S. PATENT DOCUMENTS 954,755 A * 4/1910 Molenaar ..... 40/497
3,839,821 A * 10/1974 Forsman ..... 40/1.5 X
4,341,035 A * 7/1982 Jaworski et al. ..... 40/587 X
5,190,354 A * 3/1993 Levy et al. ..... 40/587 X
5,203,183 A * 4/1993 Salerno ..... 63/12
5,490,342 A * 2/1996 Rutterman ..... 40/587

* cited by examiner

*Primary Examiner*—Brian K. Green

(57) ABSTRACT

Disclosed are promotional products such as buttons, badges, toys, signs, and displays, and in particular promotional products that display inscriptions vertically, no matter the orientation of the product, more particularly words or phrases spelled the same forwards as backwards, as for example BOB or MOM or WWW. The products each have a rotatable shaft connected to a base member, and a plurality of sheets imprinted with inscriptions and attached by pins onto the base member so that the sheets hang vertically. As the shaft rotates, the base member rotates but the sheets continue to maintain a vertical position.

1 Claim, 7 Drawing Sheets

PROMOTIONAL PRODUCTS

BACKGROUND OF INVENTION

This invention relates to promotional products such as buttons, badges, toys, signs, and displays. In particular, it relates to promotional products that display inscriptions vertically, no matter the orientation of the product. More particularly, this invention relates to inscriptions which are words or phrases spelled the same forwards as backwards, as for example BOB or MOM. Such expressions are known as palindromes.

SUMMARY OF INVENTION

This invention is a promotional product which comprises a rotatable base member and a sheet which is imprinted with one or more inscriptions which can be letters or images. The sheet is attached to the base member by a pin or the like so that the sheet hangs loosely on the pin. As the base member rotates, the sheet continues to maintain its vertical position. When used for a palindrome, a plurality of sheets are used, arranged along the base member so that all the sheets hang loosely and vertically.

In small devices such as buttons or badges, a pin can connect to and extend through the base member so that the base member can rotate on the pin. The other end of the pin can be attached to a block such as the face of the button or badge. In larger devices, a shaft is provided, one end of which is rotatable in a block. The other end of the shaft is connected to the base member so that the base member rotates as the shaft rotates.

Promotional products of this invention include, but are not limited to, buttons, badges, signs, greeting cards, and all manner of displays such as window displays and outdoor displays, whether manually-driven, motor-driven, or wind-driven.

Where the sheets are to be used for palindromes, inscriptions that can be used include, but are not limited to: DAD, MOM, BOB, POP, SIS, WOW, WWW, SOS, TNT, PEP, BOOB, DEED, TOOT, RADAR, MADAM, and HANNAH.

SPECIFIC EXAMPLES OF INVENTION

Referring now to FIGS. 1, 2, 3A, 3B, and 3C, the badge 100 supports a pin 101. Mounted on the pin is a base member 102. Sheets 106, 107, and 108 with imprinted letters, B, O, and B are attached by pins 103, 104, and 105 to the base member.

As the base member rotates, such as by the person wearing the badge moving or spinning the base member, the sheets continue to maintain their vertical position.

Figure 1:
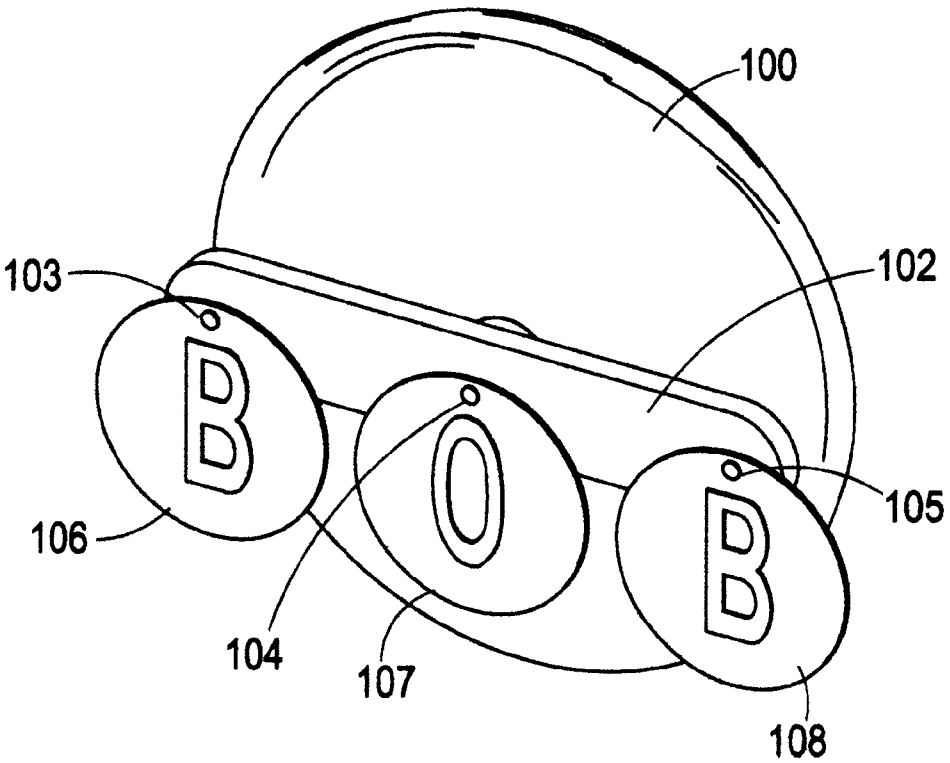
FIG. 1 is a front perspective view of a badge made in accordance with this invention.
Figure 2:
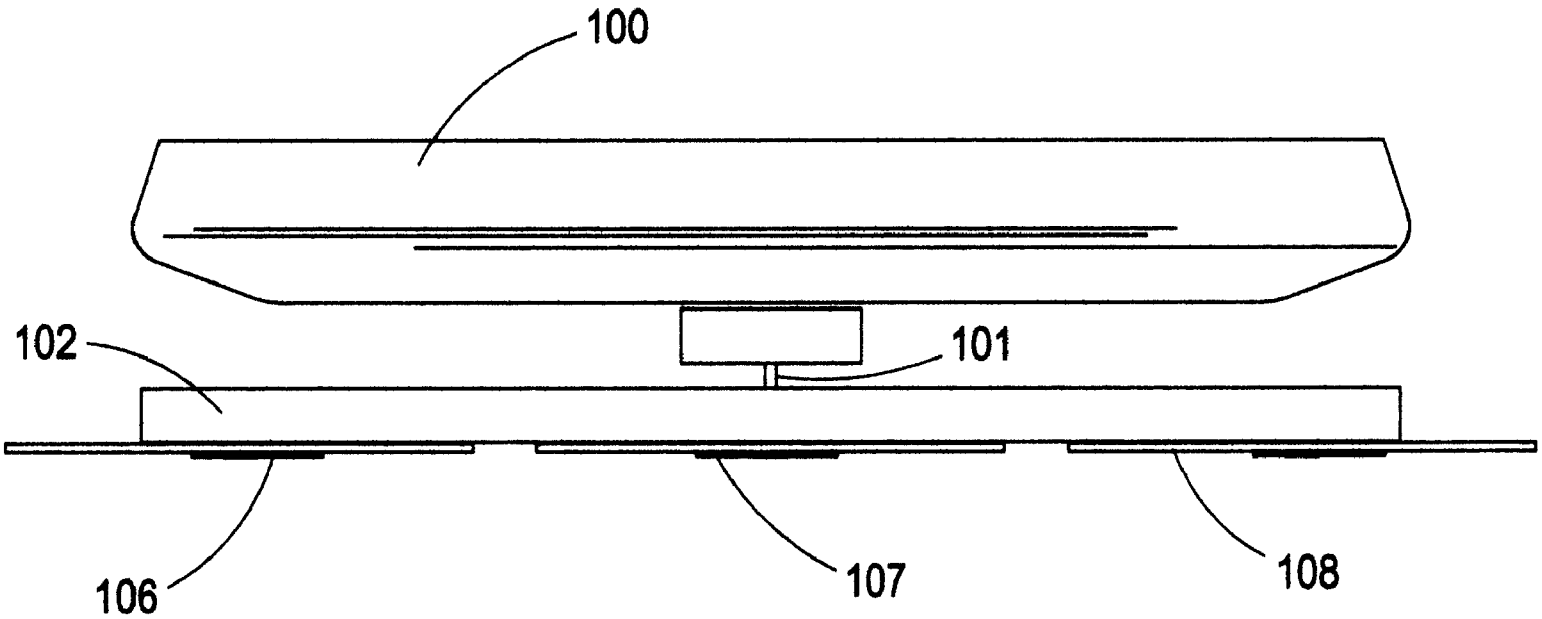
FIG. 2 is a top view of the badge of FIG. 1.
Figure 3C:
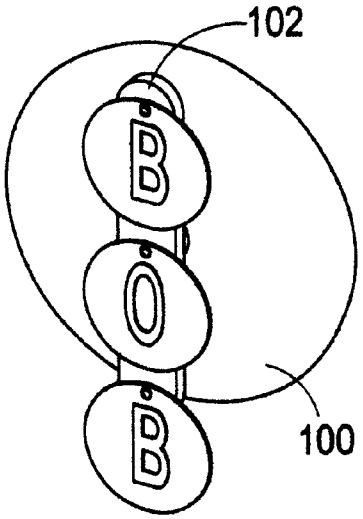
FIGS. 3A–3C is a sequence of schematic front perspective views of the badge of FIGS. 1–2 as the shaft is rotated.
Figure 3B:
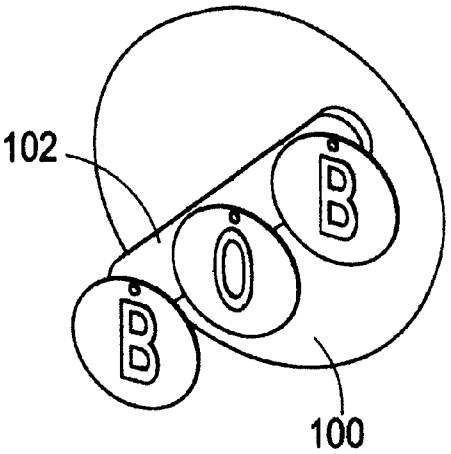
Figure 3A:
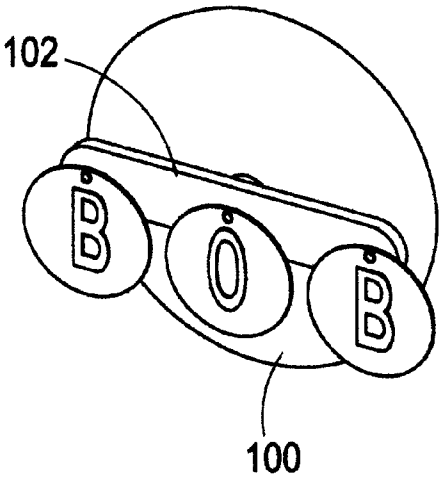
Figure 4:
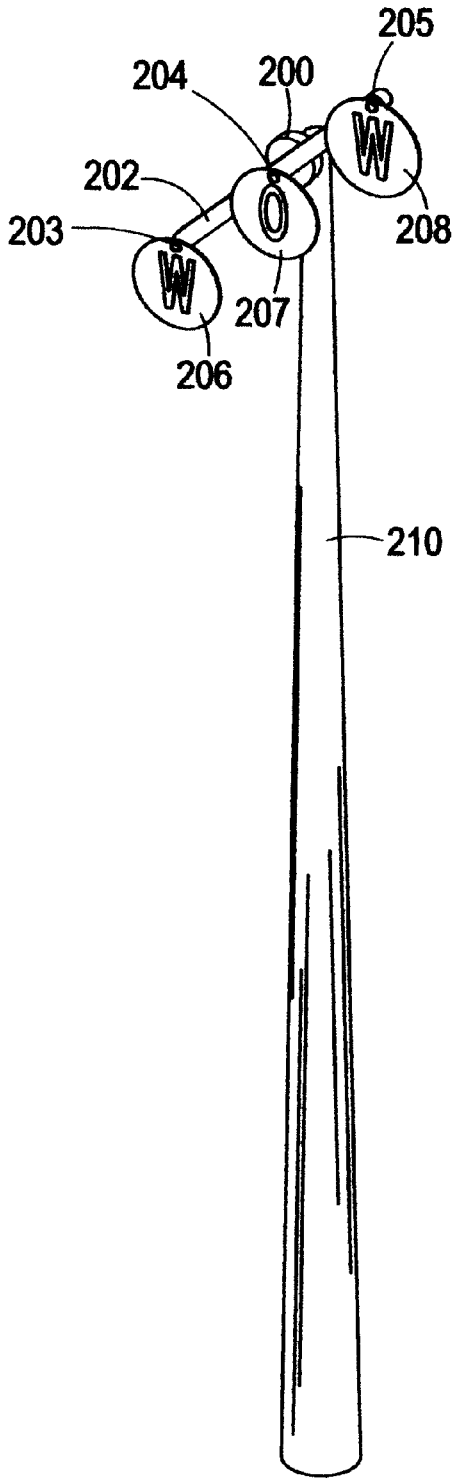
FIGS. 4 and 4A illustrate an example of the invention wherein a large outdoor sign display is mounted on a high pole.
Figure 4A:
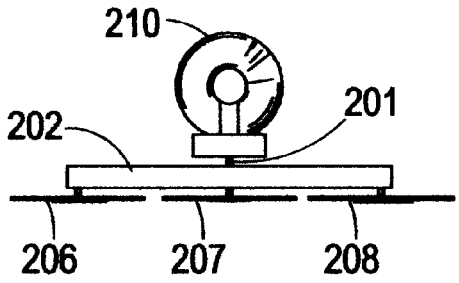

Referring now to the example illustrated in FIGS. 4, and 4A, the bracket 200 is mounted on a pole 210. The bracket 200 acts as a block to support a horizontal rotatable shaft 201 on which is mounted base member 202. Sheets 206, 207, and 208 with imprinted letters W, O, and W are hung by pins 203, 204, and 205 on the base member. Rotation of the shaft can be accomplished by the wind or by a motor (not shown). As the shaft rotates, the sheets continue to maintain their vertical position.

Figure 5:
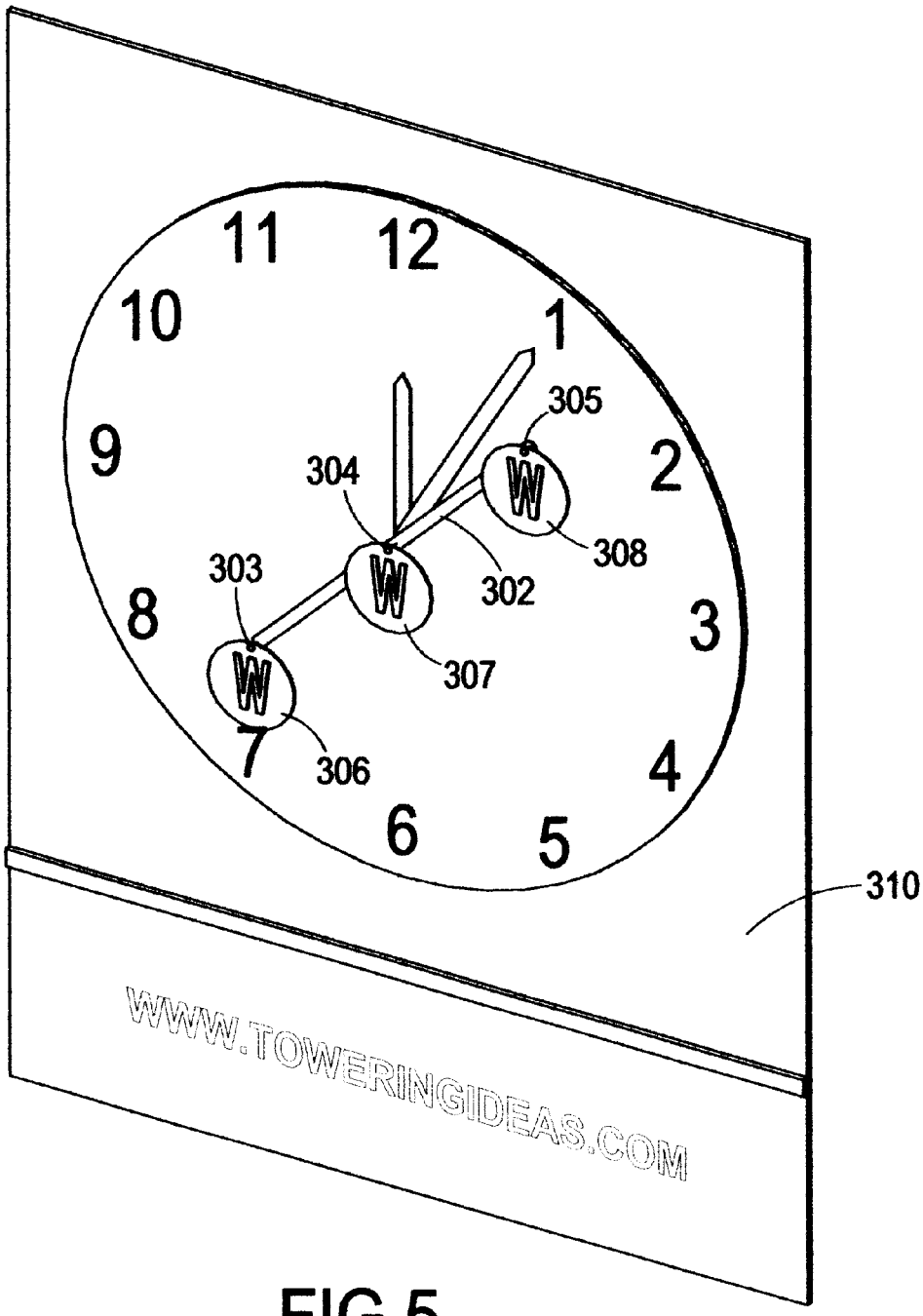
FIG. 5 illustrates an example of the invention adapted for a clock.

Referring now to FIG. 5, clock 310 supports a horizontal rotatable shaft (hidden) which is connected to the clock driving shaft (not illustrated) so that the shaft rotates as the clock shaft rotates. Base member 302 is mounted on the shaft. Sheets 306, 307, and 308 with imprinted letters W, W, and W are hung by pins 303, 304, and 305 on the base member 302. As the clock hands move, so does the base member 302, but the sheets 306, 307, and 308 continue to hang vertically.

Figure 6:
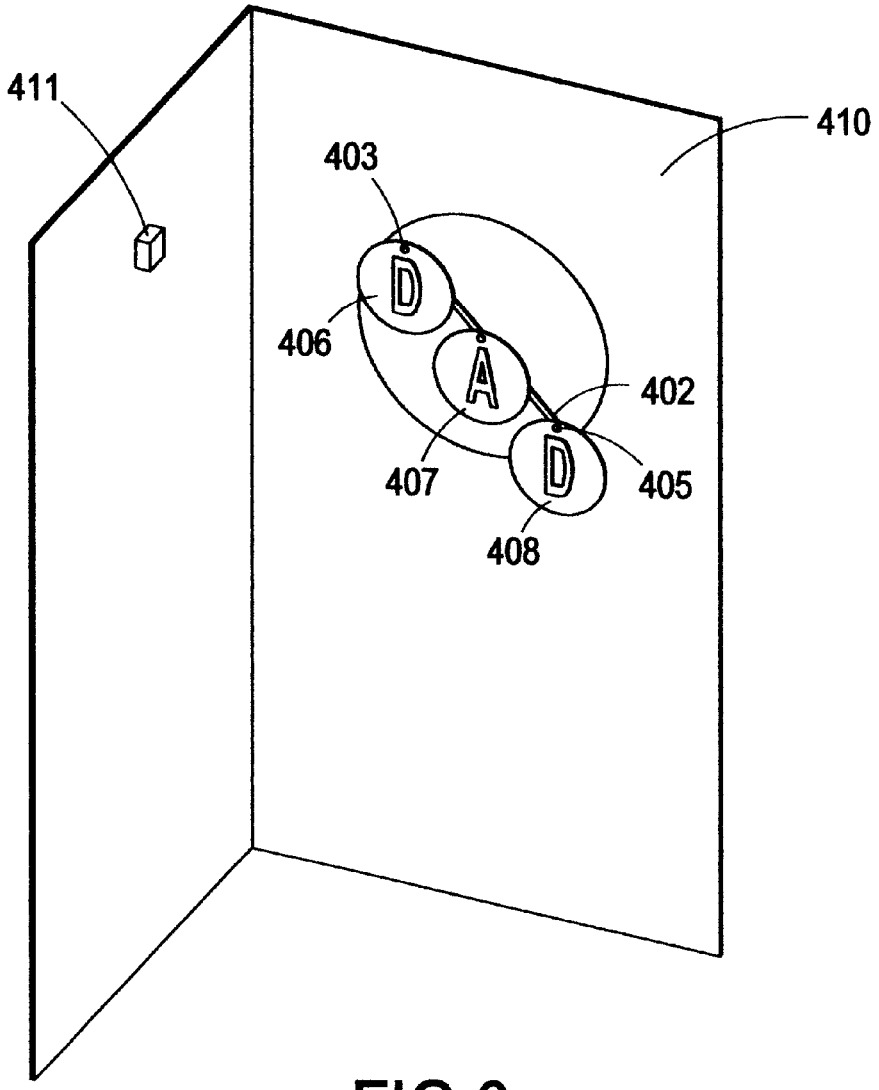
FIG. 6 is a view in open position of a greeting card which is transported in closed condition.
Figure 6A:
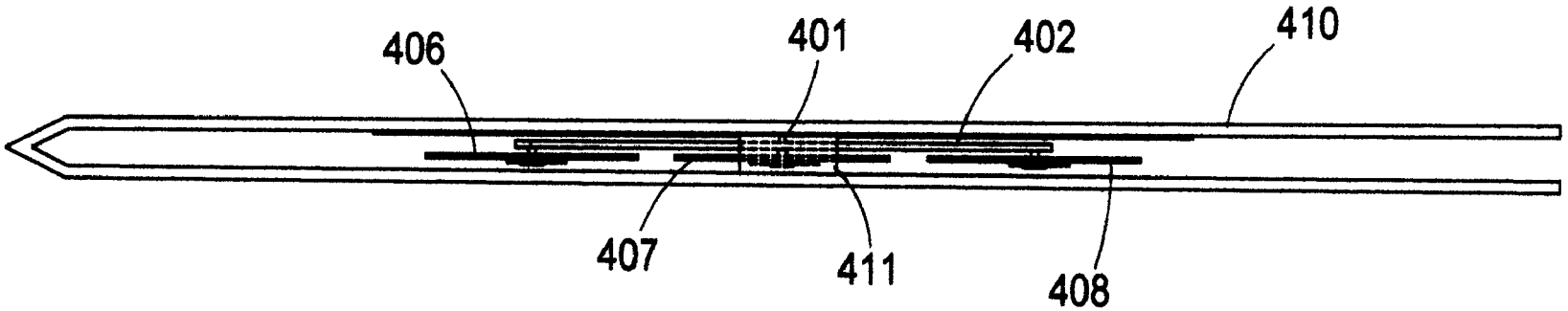
FIG. 6A is a top view of the greeting card in closed condition. Opening the card triggers the movement of a device made in accordance with this invention.

Referring now to the greeting card device of FIGS. 6 and 6A, the greeting card 410 supports horizontal rotatable shaft 401. On the back of the card 410 is mounted a power assembly (not illustrated). The assembly can be a spring-loaded motor gear assembly or a battery-powered motor. One end of a thin shaft 401 is driven by the power assembly, and the other end is connected to and turns base member 402. Sheets 406, 407, and 408 with imprinted letters D, A, and D are hung by pin 403, shaft 401, and pin 405 on base member 402. When the cardboard block 411 is pulled away by the opening of the greeting card, the power assembly is actuated so that the shaft and hence the base member rotates. The sheets 406, 407, and 408 continue to hang vertically.

What is claimed is:

1. A promotional product attached to a wearable display which is selected from the group consisting of buttons and badges; said product comprising a rotatable base member and at least three sheets, each sheet bearing an inscription; wherein each said sheet hangs on a separate pin on said base member and is rotatable relative to said base member; said product being so characterised in that as said base member rotates, all said sheets maintain a vertical position and said inscriptions form a palindrome.

* * * * *